United States Patent [19]

Buxton et al.

[11] Patent Number: 4,926,018

[45] Date of Patent: May 15, 1990

[54] MOVING MAINS ARC MOVEMENT LOOP

[75] Inventors: Clifford A. Buxton; David A. Leone, both of Lawrenceville, Ga.

[73] Assignee: Siemens Energy & Automation, Inc., Atlanta, Ga.

[21] Appl. No.: 242,094

[22] Filed: Sep. 8, 1988

[51] Int. Cl.[5] ..... H01H 33/18

[52] U.S. Cl. ..... 200/147 R; 200/146 R

[58] Field of Search ..... 200/147 R

[56] References Cited

U.S. PATENT DOCUMENTS

| | | | |
|---|---|---|---|
| 2,777,921 | 1/1957 | Latour | 200/147 R |
| 3,192,344 | 6/1965 | Cole | 200/116 |
| 3,345,485 | 10/1967 | Engel | 200/146 R |
| 3,585,329 | 6/1971 | Walker et al. | 200/146 R |
| 4,635,012 | 1/1987 | Kohanawa et al. | 200/147 R |
| 4,672,157 | 6/1987 | Neel et al. | 200/144 R |

*Primary Examiner*—Robert S. Macon

*Attorney, Agent, or Firm*—James G. Morrow; Lawrence C. Edelman

[57] ABSTRACT

A contact blade for a circuit breaker configured such that the current path in the blade produces a magnetic field which affects an arc present at the contact of the blade. The configuration of the blade produces a substantially U-shaped current loop in the blade, wherein one leg of the current loop has its main component substantially parallel to, but in the direction opposite to, the main component of the current in the second leg of the loop. When an arc is formed at the contact, the current from the second leg flows through the contact and into an arc, while the current in the first leg of the loop produces a magnetic field which acts upon the arc and forces the arc off of and away from the contact.

6 Claims, 1 Drawing Sheet

MOVING MAINS ARC MOVEMENT LOOP

BACKGROUND OF THE INVENTION

This invention relates to a main contact blade assembly for a switching device, and more particularly, to a contact blade assembly for a circuit breaker wherein the configuration of the contact blade affects the arc produced between the contacts of a circuit breaker.

When the current carrying contacts of a circuit interrupting device are separated while a current is flowing through the contacts, an arc can be formed between the contacts. Depending on the intensity and duration of the arc, the contact material and materials surrounding the arc experience varying degrees of deterioration. For example, the contact surfaces can be eroded such that the resistance of the contact interface increases causing increased heating and further deterioration of the contacts. In dealing with this problem, it is desirable to either extinguish the arc in the shortest period of time possible and/or move the arc from between the contacts to a location where the damage done by the arc does not severely affect the operation of the circuit interrupting device.

Accordingly, it is important to provide means for extinguishing and/or moving an arc to a location where damage done by the arc is not critical.

SUMMARY OF THE INVENTION

An object of the present invention is to provide a means for moving an arc from between the primary contacts of a circuit interrupting device to either the secondary contacts and/or means for disbursing the arc, such as an arc horn.

Accordingly, there is provided a movable contact blade comprising a contact means, and means for providing a magnetic field adjacent to the contact means, wherein the magnetic field is adapted to force an electric arc away from the contact means.

An advantage of the present invention is that the means for moving the arc is an integral part of the contact carrying member. Another advantage of the present invention is that the means for moving the arc is in close proximity to the primary contacts.

Various other objects and advantages of the present invention will become apparent from the following description, with reference to the accompanying drawing.

DETAILED DESCRIPTION OF THE PREFERRED EMBODIMENT

Figure 1:
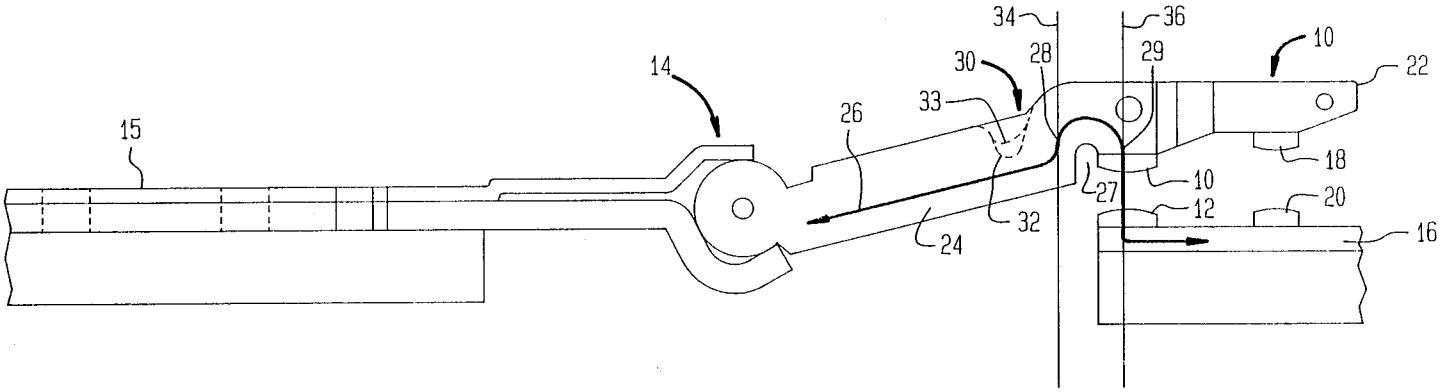
FIG. 1 is a side view of the current carrying contact blade assembly.

Referring to the drawings, FIG. 1 illustrates a current path for a circuit breaker such as a molded case circuit breaker. For opening and closing the primary contacts 10, 12 there is provided a pivoting connection 14 and a movable contact blade 24 which provides a current path between the terminal 15 and the terminal 16. To interrupt the current carried by the circuit breaker, the contact 10 on the contact blade 24, and the fixed contact 12 are pulled apart. Under certain conditions, separating the contacts 10, 12 causes an arc to form between these contacts 10, 12.

As discussed above, it is important to move the arc from the primary contacts 10, 12 to an arc dispersing means such as a pair of secondary contacts 18, 20 and/or an arc horn 22. Moving the arc can be facilitated by producing a magnetic field which acts on the arc. An effective way to produce a magnetic field which will apply a force to the arc is to provide an electric current near the arc wherein the path of the current is substantially parallel to the axis of the arc, but the flow of current is in the direction opposite to the flow of current in the arc. In this situation, the force of the magnetic field produced by the current will force the arc away from the current path.

In the preferred embodiment of the contact blade 24, the blade 24 is configured such that a generally U-shaped current loop 26 is present in the blade 24 near the primary contacts 10, 12. As illustrated in the FIG. 1, the configuration of the blade 24 includes a notch 27 at the bottom of the blade 24 located adjacent to the contact 10 and a depressed region 30 at the top of the blade 24. The size of the depressed region 30 can be varied in size depending on the strength requirements of the blade 24 and the extent to which the legs 28, 29 of the U-shape current loop 26 are required to be parallel. For example, the depressed region 30 could be made so that the top contour of the blade 24 follows the dashed line 32 or the dashed line 33.

Referring to FIG. 1, when the depressed region 30 follows the dashed line 32, the main component of the load current in the right-most leg 28 of the current loop 26 substantially follows a line 34 parallel to the axis of the arc 36. When the depressed region 30 follows the contour of the solid line defining the top of the blade 24, the load current in the right-most leg 28 has a smaller component along the line 34. With either configuration, the load current is utilized by a means provided for producing a magnetic field which forces an arc from between the primary contacts 10, 12 toward the secondary contacts 18, 20 on the arc horn 22.

While one embodiment of a current carrying contact blade and several modifications thereof have been shown and described in detail herein, various other changes and modifications may be made without departing from the scope of the present invention. For example, the contact configuration can be varied depending on mechanical and/or electrical considerations.

We claim:

1. A movable contact blade comprising:

an elongated blade element having a top and bottom side;

a contact disposed on the bottom side of said element;

said element including a notch extending inwardly from the bottom side of said element adjacent to said contact; and said element further including a depression extending inwardly from the top side of the element, offset from the notch and said contact such that the notch is between the depression and the contact;

said notch and depression being disposed to define a current path through said blade element disposed such that a current flow in the path will produce a magnetic field to force an electric arc away from the contact.

2. The movable contact blade of claim 1 wherein the contact means comprises a first electrical contact on the contact blade.

3. A movable contact carrying arm which provides a conductor for an electric current, the arm including a first end, a top surface and a bottom surface, the arm comprising:

a first electrical contact for carrying the electric current positioned at the first end on the bottom surface, the first electrical contact being engageable with a second electrical contact;

a notch in the bottom surface and adjacent to the first electrical contact; and a depression in the top surface above the notch and offset from the notch such that the notch is between the depression and the first electrical contact;

the notch and the depression cooperating to define a current path in the arm adjacent to the first electrical contact such that a magnetic field produced by the electric current tends to force an arc formed between the first contact and the second contact away from the contacts.

4. A contact blade for a switching device comprising:

a blade element having top and bottom edges and an end;

a contact portion disposed on said blade element bottom edge inwardly from said end; and means for directing arcs away from said contact portion toward said blade element end, said means fo directing comprising:

a notch formed in said blade element extending inwardly from said bottom edge adjacent to said contact portion; and a depression formed in said blade element extending inwardly from said top edge laterally offset from said notch;

said notch and said depression being relatively disposed to define a current path through said blade element, current flowing through said path generating a magnetic field to repell arcs at said contact portion.

5. A pivotable current carrying contact blade for a circuit breaker of the type including a first contact terminal, the first contact terminal including a primary contact and a secondary contact, the contact blade having a top side, a bottom side, a first end, a second end, and a longitudinal axis extending through the first end and second end, the contact blade comprising:

means for contacting the primary contact positioned at the first end;

a notch generally adjacent to the means for contacting and extending from the bottom side toward the longitudinal axis; and a depression extending from the top side toward the longitudinal axis wherein the notch is positioned between the depression and the means for contacting;

said depression being positioned relative to the notch to define a current path for carrying current to produce a magnetic field adjacent to the means for contacting, wherein the magnetic field forces an arc between the means for contacting and the primary contact toward the secondary contact.

6. The contact blade of claim 5 further comprising means for contacting the secondary contact.

* * * * *